US006875042B2

(12) United States Patent
Melzner et al.

(10) Patent No.: US 6,875,042 B2
(45) Date of Patent: Apr. 5, 2005

(54) LAMP HOLDER

(75) Inventors: Erwin Melzner, Kirchseeon (DE); Joachim Köll, Munich (DE)

(73) Assignee: Arnold & Richter Cine Technik GmbH & Co. Betriebs KG, Munich (DE)

( * ) Notice: Subject to any disclaimer, the term of this patent is extended or adjusted under 35 U.S.C. 154(b) by 0 days.

(21) Appl. No.: 10/475,551

(22) PCT Filed: Apr. 15, 2002

(86) PCT No.: PCT/DE02/01461

§ 371 (c)(1),
(2), (4) Date: Oct. 20, 2003

(87) PCT Pub. No.: WO02/087030

PCT Pub. Date: Oct. 31, 2002

(65) Prior Publication Data

US 2004/0115979 A1 Jun. 17, 2004

(30) Foreign Application Priority Data

Apr. 20, 2001 (DE) ..... 101 20 741

(51) Int. Cl.[7] ..... H01R 13/62

(52) U.S. Cl. ..... 439/366; 439/356; 439/372; 439/263

(58) Field of Search ..... 439/241, 232, 439/356, 366, 350, 372, 263, 256, 257

(56) References Cited

U.S. PATENT DOCUMENTS 2,286,991 A * 6/1942 MacFadden ..... 439/366
2,372,987 A * 4/1945 Shaver ..... 439/366
2,388,650 A * 11/1945 Whittell et al. ..... 439/366
2,428,631 A * 10/1947 Millette ..... 439/366
2,432,435 A * 12/1947 Millette ..... 439/366
3,942,858 A 3/1976 Ouchi
4,280,029 A * 7/1981 Lewis ..... 200/50.01
4,553,805 A * 11/1985 Aikens ..... 439/325
4,669,796 A * 6/1987 Carter ..... 439/372
4,919,627 A * 4/1990 Cable ..... 439/263
5,542,857 A 8/1996 Hume et al.

FOREIGN PATENT DOCUMENTS

DE 198 16 364 A1 10/1999
DE 199 27 198 A1 7/2000
GB 2105531 A * 3/1983 ..... 439/366

OTHER PUBLICATIONS

English Translation of International Preliminary Examination Report of PCT/DE02/01461, dated Feb. 28, 2003.
International Search Report of PCT/DE02/01461, dated Aug. 12, 2002.
International Preliminary Examination Report of PCT/DE02/01461, dated Feb. 28, 2003.
Corresponding German application Examination Report, dated Apr. 17, 2002.

* cited by examiner

*Primary Examiner*—Tho D. Ta
(74) *Attorney, Agent, or Firm*—Christie, Parker & Hale, LLP

(57) ABSTRACT

A holder for a lamp with a glass vessel and a lamp base includes at least one spring element and at least one connecting part which can move relative to the spring element between two positions. In the first position the locking part thereby enters into contact with the spring element to that this is blocked and pressed against the lamp base of a lamp inserted in the bushing of the holder. In the second position the locking part exerts no or only reduced pressure on the spring element.

19 Claims, 4 Drawing Sheets

LAMP HOLDER

CROSS-REFERENCE TO RELATED APPLICATION

This application is a National Phase Patent Application of International Application Number PCT/DE02/01461, filed on Apr. 15, 2002, which claims priority of German Patent Application Number 101 20 741.7, filed on Apr. 20, 2001.

FIELD

The invention relates to a holder for a lamp with a glass vessel and a lamp base.

BACKGROUND

Spotlights for stage, television, film and photographic studios are known which are operated with halogen incandescent lamps or discharge lamps of low output. Spotlights of this kind have a lamp housing which comprises in particular a starter unit, a reflector and a holder for the spotlight bulb. The holder has a bushing which receives the lamp base of the spotlight.

Normally the lamp bases are designed according to the international standard IEC 61 of the International Electrotechnical Commission. The IEC 61 standard describes in particular lamp bases of the types GY 9.5, GZ 9.5, GY 16, GTX 9.5, GZY 9.5 and GZZ 9.5 whereby the types with 3 letters relate to discharge lamps and the types with two letters relate to halogen lamps. The numbers indicate the spacing of the contact pins of the lamps.

In order to fix the lamp base in the lamp holder it is known that the lamp bases have a lateral circumferential nose with a run-up slope to the lamp shaft. This nose is in the known lamp holders held by two resilient elements or one resilient element and one fixed plate which are a part of the lamp holder.

The said IEC 61 standard permits relatively large tolerances when configuring the lamp base. This has the result that the known lamp holders with two resilient elements or one resilient element and one fixed plate do not guarantee accurate fixing of the lamp in the lamp holder. This leads on the one hand to the problem that the lamps accidentally become loose through vibrations and disturbances during transport and operation.

On the other hand the problem arises that the lamp sits poorly i.e. not precisely centered, in the lamp holder. Since high power light guidance systems which are based on parabolic, parabolic-like, elliptical or approximately elliptical reflectors, only reveal their full effectiveness when the lamp is located precisely in the center of the reflector, a poor seat of the lamp leads to an impairment in the lighting quality.

A further drawback with the known lamp holder lies in the fact that the resilient elements used can be bent as the lamp is inserted so that they lose their effect.

SUMMARY

Based on this prior art the object of the present invention is to provide a holder for a lamp which ensures accurate positioning of a lamp in the holder and reliably prevents accidental displacement or loosening of the lamp during transport and operation. In addition it is to be ensured that the insertion of a lamp in the holder can be undertaken without risk of bending existing spring elements.

According to this the holder according to one embodiment of the invention has locking means which have at least one spring element and at least one connecting part which can move relative to the spring element between two positions. In the first position the locking part thereby enters into contact with the spring element so that this is blocked and pressed against the lamp base of a lamp inserted in the bushing of the holder. In the second position the locking part on the other hand exerts no or only reduced pressure on the spring element so that this is relaxed.

By setting up a locking part which can move to and fro between two positions it is possible to accurately adjust and fix the seat of the lamp in the holder and to prevent independent loosening or displacement of the lamp during transport or operation. Thus as a result of the locking part a defined force can be exerted on the spring elements and thus on a lamp base to securely hold the lamp. In addition a simple fitting of the lamp in the holder is possible since the spring elements only exert in the one position of the locking part a force on the lamp base whilst in the other position of the locking part they are relaxed and thus in this position a lamp can be fitted in and out of the holder unimpeded by the spring elements and without risk of the spring elements bending. Even if the spring elements are bent a more secure seat of the lamp is ensured through the mechanism according to this embodiment of the invention.

In a preferred embodiment of the invention it is proposed that the locking part is movable relative to the spring element either perpendicularly or parallel to the receiving direction of the bushing. Thus, movement of the locking part preferably takes place in the horizontal or vertical direction. This permits a simple handling of the holder or locking part.

The locking, part preferably has an inclined insert guide which presses in the first position against the spring element. As a result of the inclined insert guide the pressure exerted by the locking part on the spring element becomes increasingly stronger as the locking part is moved from the second position into the first position. This enables a gradual tensioning of the spring element and fixing of a lamp mounted in the bushing.

The at least one spring element is preferably designed so that it forms a first, a second and a third region. The first region of the spring element is thereby fixed on the holder. The first region is adjoined by a second region which runs substantially parallel to the receiving direction of the bushing and thus extends in the vertical direction. The second region is adjacent to a third region which is bent away from the second region and which extends substantially perpendicular to the receiving direction of the bushing and in the direction of the bushing, thus runs substantially horizontal. The end of the third region of the spring element thereby presses against a lamp base inserted in the bushing. The design of the spring element described above enables a space-saving arrangement of the spring in the holder.

As the locking part moves from the second position into the first position the locking part presses against the second region of the spring element whereby the horizontally aligned third region of the spring element is pressed against the lamp base, more particularly against a lateral nose of the lamp base having an inclined slope.

The locking part is preferably a U-shaped or semi-circular plate with two inclined insert guides arranged symmetrically opposite one another. Longitudinal grooves are formed in the plate in the end regions or side arms thereof and by means of which the plate is movably supported on the holder. Bearing pins which engage through the longitudinal grooves and whose head area has a diameter larger than the width of the longitudinal grooves are preferably used as the bearing.

The bearing pins preferably also serve to fix a spring element so that in the preferred embodiment two spring elements are provided of which each one interacts with an arm of a plate movably fixed on the holder.

The plate is preferably fixed resiliently on the holder. To this end for example springs are provided which are mounted on the bearing pins, are thereby supported on the holder and press from below against the end areas of the plate. The resilient bearing of the holding part prevents the latter from being able to move to and fro in undefined manner thereby causing undesired noises or even damage to the holder.

The locking part is preferably movable manually between the two positions so that an operator can easily undertake locking and unlocking of a lamp inserted in the bushing.

The spring pressure of the tensioned spring elements is preferably designed so that a lamp inserted in the bushing is held firm and cannot be accidentally loosened during transport or operation. In particular the spring pressure is designed so that tolerances arising through heat radiation of the lamp or play arising as a result of the components heating up are also reliably compensated and the spring elements always press against the lamp base.

In a further advantageous development of the invention the locking part has a tab for operating the locking part which preferably projects out from the lamp housing. Operating the locking part and thus unlocking and locking the holder is hereby very simple.

BRIEF DESCRIPTION OF THE DRAWINGS

The invention will now be explained in further detail with reference to the embodiment shown in the drawings in which.

DETAILED DESCRIPTION

Figure 1B:
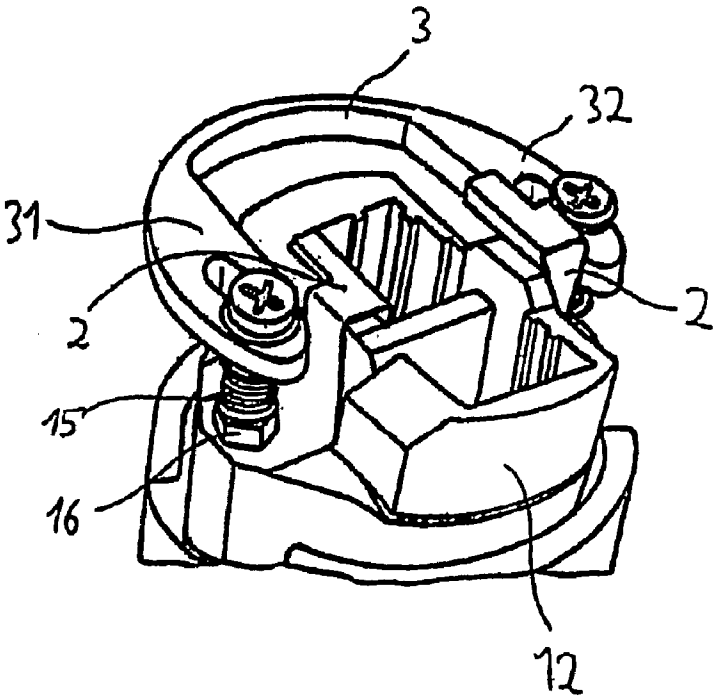
FIG. 1*b* shows a perspective view of the holder of FIG. 1*a* in which the locking part is located in a second unlocked position.

The FIGS. 1*a*-6 show a holder 1 which has a base 11, a bushing 12 with two receiving openings 12*a*, 12*b* and locking means for holding the base of a lamp inserted in the bushing 12. The lamp inserted in the bushing 12 can be in particular a halogen incandescent light or a discharge lamp of low output in which the lamp base is formed according to the IEC 61 Standard (as shown in FIGS. 5*a*-5*b*).

The locking means consist of two spring elements 2 fixed symmetrically on the holder base 11 and one U-shaped centering plate 3 which has two side arms 31, 32. As can be seen in particular from FIGS. 3*a* and 3*b*, the spring elements 2 are designed so that they have a lower region 21 fixed on the holder base 11, a substantially vertically extending region 22 and an adjoining substantially horizontally extending third region 23 which extends towards the receiving bush 12. The third region 23 forms at the end a contact pressure ramp 24 which is prepared by simply bending down the spring end.

Figure 1A:
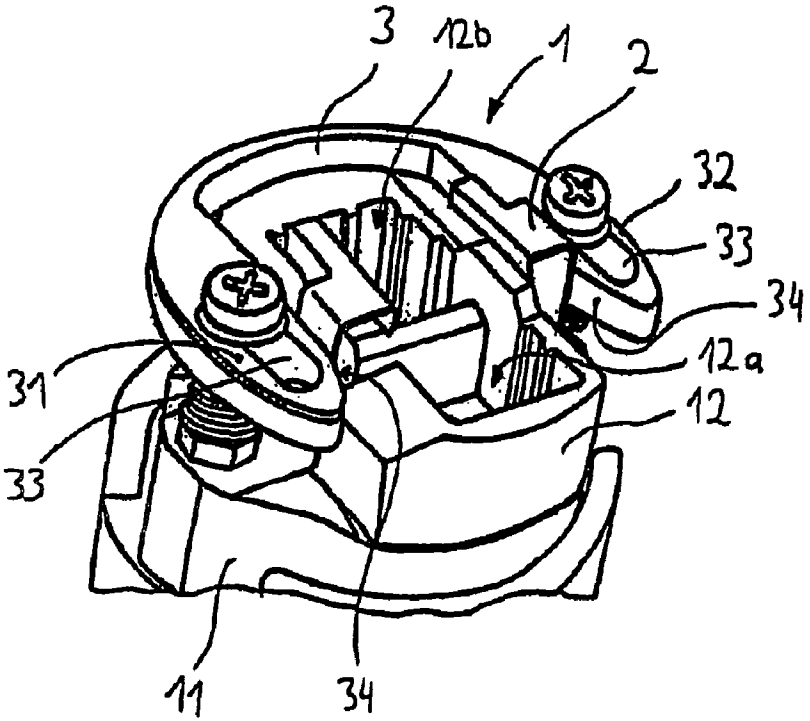
FIG. 1*a* shows a perspective view of an embodiment of a holder according to one embodiment of the invention with a locking part which is located in a first closed position.

As shown in FIGS. 1*a* and 1*b* the locking part 3 can be moved to and fro between a first position (FIG. 1*a*) and a second position (FIG. 1*b*). To this end longitudinal grooves 33 are formed in the arms 31, 32 of the locking part 2 and a guide pin or bearing pin 14 engages through same. As can be seen in particular from FIGS. 3*a*, 3*b* the bearing pin 14 is anchored in the holder socket 11 of the holder 1. The head area 14*a* of the holder pin 14 has a diameter which is larger than the width of the longitudinal grooves 33 so that the locking part 3 is fixed movable on the holder 1 through the bearing pins 14.

Additionally a heat-resistant compression spring 15 is fitted on each holder pin 14 and is supported on the one hand on the holder base 11 of the holder 1 and on the other on the underneath of the arms 31, 32 of the locking part 3, thereby ensuring a resilient bearing for the locking part 3. Preferably the bearing pin 14 has a toothed area (not shown) so that it can be adjusted in the vertical direction by means of a simple screw driver and slits formed in the head area 14*a*, whereby the compressive force of the spring 15 can be simply adjusted to the desired amount.

The bearing pins 14 also serve to fix the spring elements 2 which are fixedly screwed by their first section 21 on the holder base 11 by means of a screw 16 screwed onto the bearing pin 14.

The arms 31 of the locking part 3 each form at their inner side an inclined insert guide 34 which involves a bulge on the insides of the arms 31, 32.

Figure 2B:
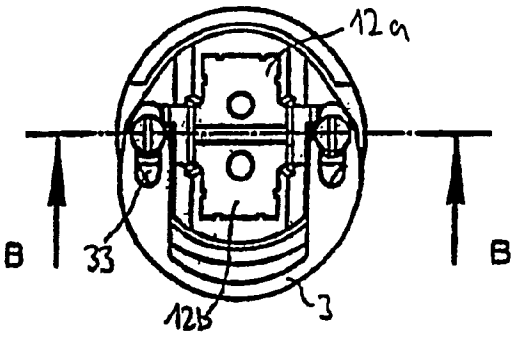
FIG. 2*b* shows a plan view of the holder of FIG. 1*b;*
Figure 3B:
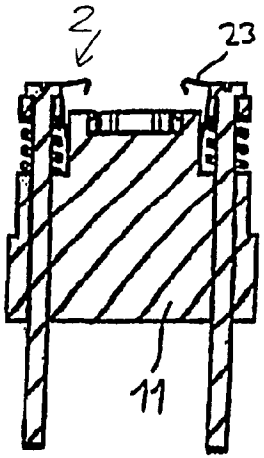
FIG. 3*b* shows a section through the holder of FIG. 2*b* along the line B—B.
Figure 2A:
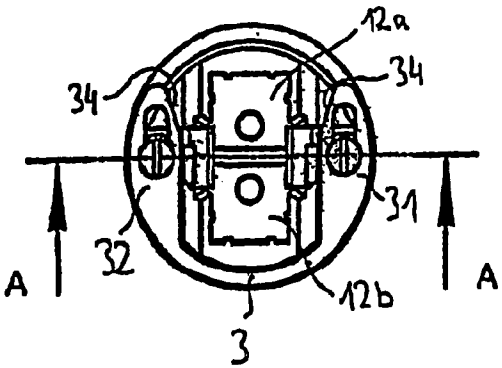
FIG. 2*a* shows a plan view of the holder of FIG. 1*a;*
Figure 3A:
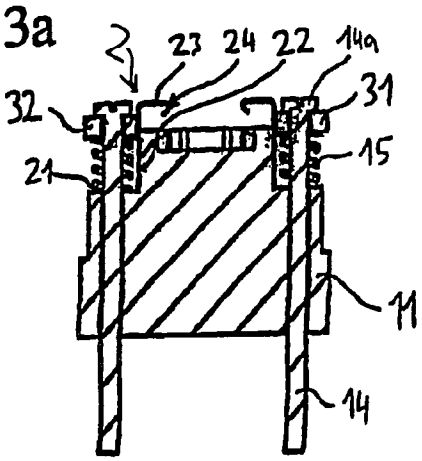
FIG. 3*a* shows a section through the holder of FIG. 2*a* along the line A—A.

The locking part 3 and the spring elements 2 interact together as follows. In FIGS. 1*b*, 2*b*, 3*b* the locking part 3 is located in a rear position in which the arms 31, 32 are moved away from the guide elements and thus are not in contact with same. The bearing pins 14 are thereby each located at the one end of the longitudinal groove 33. As can be seen in particular in FIG. 3*b* the spring elements 2 are pretensioned so that in the absence of any contact with the locking part 3 they move away from the bushing 12 and a lamp can thus be easily inserted in or removed from the bushing 12 without any obstruction though the spring elements 2.

If now the locking part 3 is moved from the rear position shown in FIG. 1*b* into the forward position shown in FIG. 1*a*, possibly by simple manual actuation of the locking part 3, the inclined insert guides 34 of the arms 31, 32 or the side faces of the arms 31, 32 of the locking part 3 enter into contact with the vertically extending area 22 of the spring element 2. The spring elements 2 and in particular the upper regions 23 of the spring elements 2 are hereby pressed under tension of the spring element 2 in the direction of the receiving opening 12. In the position illustrated in FIGS. 1*a*, 2*a*, 3*a* the contact bearing ramp 24 of the spring element 2 is located substantially closer to the receiving opening 12 than in the position of FIGS. 1*b*, 2*b*, 3*b*. By displacing the locking part 3 the spring elements 2 are then tensioned and moved in the direction of the receiving opening 12.

Figure 4B:
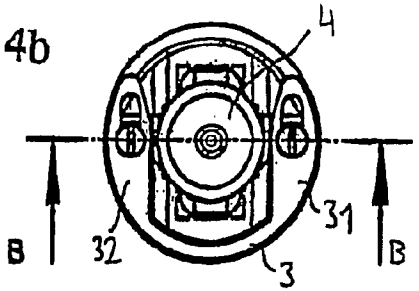
FIG. 4*b* shows a plan view of the holder of FIGS. 1*b*, 2*b*, 3*b* moved into an unlocked position with a lamp inserted in the holder.
Figure 5B:
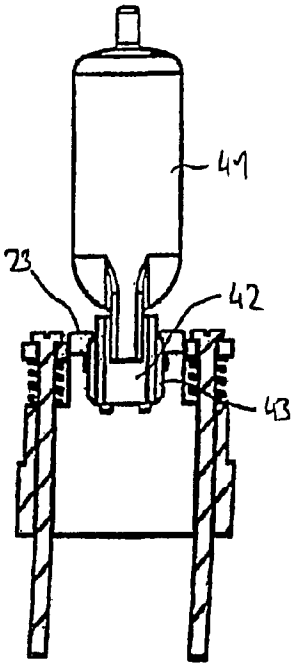
FIG. 5*b* shows a sectional view of the holder of FIG. 4*b* along the line B—B and FIG. 6 shows a perspective view of a further embodiment of a holder according to the invention in which the locking part is provided with a tab.
Figure 4A:
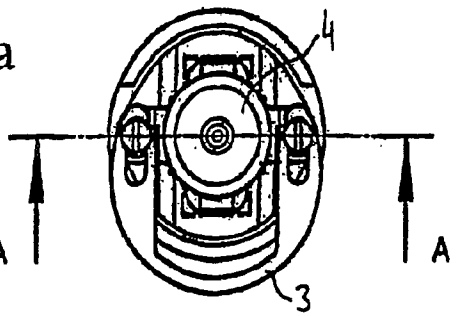
FIG. 4*a* shows a plan view of the holder of FIGS. 1*a*, 2*a*, 3*a* moved into an unlocked position with a lamp inserted in the holder.
Figure 5A:
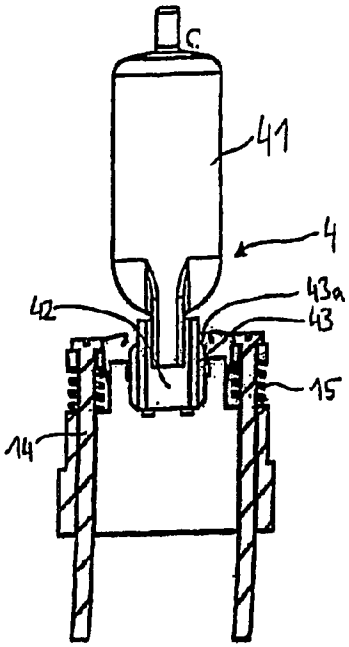
FIG. 5*a* shows a sectional view of the holder of FIG. 4*a* along the line A—A.

FIGS. 4*a*, 4*b*, 5*a*, 5*b* show the holder according to the invention with the discharge lamp 4 inserted in the receiving opening 12. FIGS. 4*a*, 5*a* thereby show the situation where the locking part has been moved into the rear position (unlocked) and FIGS. 4*b*, 5*b* show the situation where the locking part 3 is located in the forward position (locking) and presses against the spring elements 2.

The lamp 4 has a glass body 41 and a base 42. A lateral nose 43 is formed circumferentially on the lamp base 42 and extends with an extension slope 43*a* towards the base 42. As can be seen in particular in FIG. 5*b* the contact pressure area 23 of the spring element 2 in the locking position adjoins the run-up slopes 43*a* of the base 42. A secure holding and positioning of the lamp base in the bushing 12 is hereby ensured.

The spring pressure exerted by the spring elements 2 on the lamp base 42 is thereby calculated so that the lamp is fixed and during transport or during operation of the lamp cannot become independently loosened. When calculating the spring pressure it is also necessary to take into account a possible heat expansion of the lamp base during operation of the lamp.

When the locking part 3 is pressed backwards away from the locking position the spring elements 2 snap away from the lamp base 42 according to FIG. 5*a* and the lamp can be consequently removed from or inserted in the holder without any problem.

Figure 6:
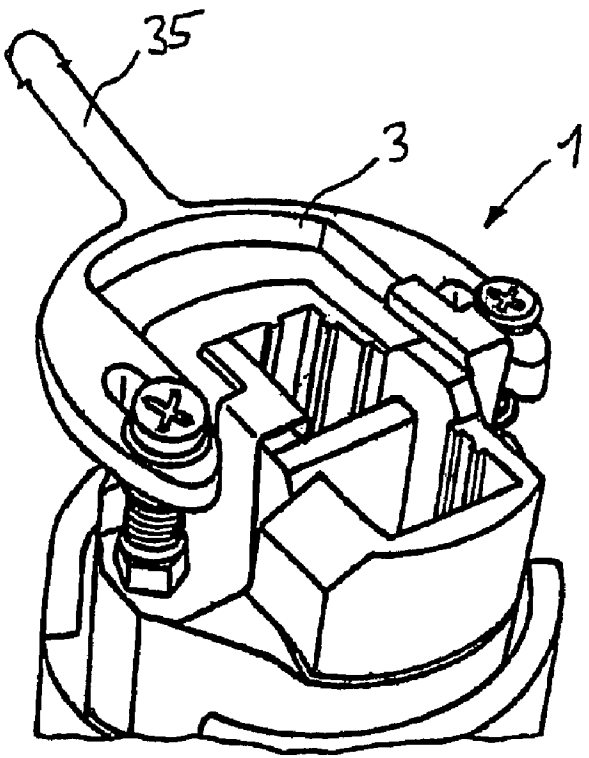

In the embodiment according to FIG. 6 the locking part 3 has a tab 35 so that the locking part 3 can be easily moved to and fro between the locking position and the unlocking position. The tab 35 preferably projects out from the lamp housing (not shown) surrounding the holder so that the locking part 3 can be actuated without having to reach into the lamp housing.

The invention is not restricted in its design to the embodiments illustrated above. It is only essential for the invention that to lock the lamp in the bushing of the holder at least one spring element and at least one locking part movable relative to the spring element between two positions, are provided according to the claims whereby in the one position the locking part enters into contact with the spring element so that the spring element is pressed against the base of a lamp which is inserted in the bushing whilst in the other position the locking part exerts no or only a reduced pressure on the spring element.

What is claimed is:

1. A holder for a lamp with a glass vessel and a lamp base, comprising:

a bushing configured to receive the lamp base; and a locking apparatus to lock the lamp base in the bushing, wherein the locking apparatus comprises at least one spring element and at least one locking part configured to be movable between a first position and a second position relative to the spring element such that in the first position the locking part contacts the spring element so that the spring element is tensioned and pressed against the lamp base when said lamp base is inserted in the bushing, and in the second position the locking part exerts a reduced pressure on the spring element, and wherein the locking part is movable relative to the spring element perpendicular to a lamp base receiving direction of the bushing.

2. The holder according to claim 1 wherein the locking part is movable relative to the spring element in a direction parallel to a lamp base receiving direction of the bushing.

3. The holder according to claim 1, wherein the locking part exerts no pressure on the spring element in the second position.

4. The holder according to any one of claims 1, and 3, wherein the locking part has an inclined insert guide which presses against the spring element in the first position of the locking part.

5. The holder according to claim 1, wherein the tensioned spring element is configured to press against an inclined ramp of a lateral circumferential nose of said lamp base when said lamp base is inserted in the bushing.

6. The holder according to claim 1, wherein a second spring element is provided, arranged opposite from and on a different side of the holder as the spring element.

7. The holder according to claim 1, wherein the locking part is manually movable between the first and second positions.

8. The holder according to claim 1, wherein spring pressure of the tensioned spring elements in the first position is such that if said lamp were inserted in the bushing, it would be held firm and restrained against independently loosening during transport or operation.

9. The holder according to claim 1, wherein the locking part has a tab for actuating the locking part.

10. The holder according to claim 1, wherein the spring element has a first, a second and a third region whereby the first region is fixed on the holder, the second region extends substantially parallel to a lamp base receiving direction of the bushing and the third region extends toward the bushing substantially perpendicular to the lamp base receiving direction of the bushing.

11. The holder according to claim 10 wherein the locking part has an inclined insert guide which presses against the second region of the spring element in the first position of the locking part.

12. The holder according to claim 10, wherein the third region of the spring element forms an inclined slope with which the tensioned spring element adjoins and presses against an inclined ramp of a lateral nose of said lamp base when said lamp base is inserted into the bushing.

13. The holder according to claim 1, wherein spring pressure of the tensioned spring elements in the first position is designed such that tolerances arising through heat radiation of said lamp inserted in the bushing are compensated and the spring elements are configured to press against the lamp base when said lamp is inserted in the bushing.

14. The holder according to claim 13, wherein the spring elements in the first position are configured to press against an inclined slope of a nose of the lamp base when said lamp is inserted in the bushing.

15. A holder for a lamp with a glass vessel and a lamp base, comprising:

a bushing configured to receive the lamp base; and a locking apparatus to lock the lamp base in the bushing, wherein the locking apparatus comprises at least one spring element and at least one locking part configured to be movable between a first position and a second position relative to the spring element such that in the first position the locking part contacts the spring element so that the spring element is tensioned and pressed against the lamp base when said lamp base is inserted in the bushing, and in the second position the locking part exerts a reduced pressure on the spring element, wherein the locking part is one of a U-shaped and a semi-circular plate with two symmetrically disposed side arms.

16. The holder according to claim 15, wherein longitudinal grooves are formed in the two arms through which the locking part is movable.

17. The holder according to any one of claims 15 and 16, wherein the locking part is resiliently mounted.

18. The holder according to claim 16, wherein in each of the longitudinal grooves is an anchored bearing pin having a head area with a diameter which is larger than a width of the longitudinal grooves.

19. A holder for a lamp with a glass vessel and a lamp base, comprising:

a bushing configured to receive the lamp base;

a locking apparatus to lock the lamp base in the bushing, wherein the locking apparatus comprises at least one spring element and at least one locking part configured to be movable between a first position and a second position relative to the spring element such that in the first position the locking part contacts the spring element so that the spring element is tensioned and pressed against the lamp base when said lamp base is inserted in the bushing, and in the second position the locking part exerts a reduced pressure on the spring element; and at least one spring pressing against an underside of the locking part.

* * * * *

UNITED STATES PATENT AND TRADEMARK OFFICE

CERTIFICATE OF CORRECTION

PATENT NO. : 6,875,042 B2
DATED : April 5, 2005
INVENTOR(S) : Melzner et al.

It is certified that error appears in the above-identified patent and that said Letters Patent is hereby corrected as shown below:

Title page,
Item [57], ABSTRACT,
Lines 5-6, delete “to that this”, insert -- so that it is --.

Signed and Sealed this

Twenty-ninth Day of November, 2005

JON W. DUDAS
*Director of the United States Patent and Trademark Office*